US006561477B1

(12) United States Patent
Prive

(10) Patent No.: US 6,561,477 B1
(45) Date of Patent: May 13, 2003

(54) ARCHERY BOW HANGER

(76) Inventor: Bernard David Prive, 365 Glen Rd., Newport, VT (US) 05855-9767

( * ) Notice: Subject to any disclaimer, the term of this patent is extended or adjusted under 35 U.S.C. 154(b) by 0 days.

(21) Appl. No.: 10/144,263

(22) Filed: May 13, 2002

(51) Int. Cl.[7] ..... B42F 13/00
(52) U.S. Cl. ..... 248/339; 124/23.1; 248/304; 248/690
(58) Field of Search ..... 248/339, 340, 248/304, 317, 682, 690, 692, 215; 124/23.1, 86

(56) References Cited

U.S. PATENT DOCUMENTS 4,944,434 A * 7/1990 Hamilton ..... 224/482
5,924,667 A * 7/1999 Grahn et al. ..... 248/304
6,059,240 A * 5/2000 Gorsuch ..... 124/86

* cited by examiner

*Primary Examiner*—Ramon O. Ramirez

(57) ABSTRACT

The archery bow hanger provides an archer with the ability to hang his bow at anytime while in the woods, a tree stand, a ground stand, or a hunting blind. The bow is always within reach, even when climbing a tree, and arrows can be notched while the bow is hanging so that the archer is ready to shoot at all times. Use of the archery bow hanger increases the enjoyment of hunting by freeing the archer's hands for other activities such as binocular usage, relaxation, eating, and drinking. By providing an alternative to leaning the bow against a tree or laying it on the ground, this invention keeps the bow free of leaves, dirt, bark, twigs, grass, or mud. The archery bow hangar consists mainly of a hollow metal tube with a bracket on one end and a hook on the other end. The bracket is adaptable for right and left-handed archers and is mounted on the bow by attaching it at the quiver or sight mount screw holes. Hanging the bow is accomplished by placing the hook over a tree limb or in a screw eye that is inserted into a tree or other suitable surface.

6 Claims, 3 Drawing Sheets

ARCHERY BOW HANGER

BACKGROUND OF THE INVENTION

1. Field of the Invention

The present invention relates to an archery accessory for use by archery enthusiasts and hunters in connection with hanging an archery bow, and specifically a compound bow. The archery bow hanger has particular utility in connection with providing the ability to hang the bow at anytime rather than placing it on the ground which brings it in contact with dirt, mud, grass, leaves, and sticks.

2. Description of the Prior Art

On the archery range and in hunting, the bow is not constantly in use. Bow hangers are desirable for allowing the archer free use of his hands and for providing a means for putting the bow aside without laying it against a tree where it can be damaged if it falls or placing it on the ground which brings the bow in contact with leaves, twigs, dirt, bark, and mud.

The use of bow hangers is known in the prior art. For example, U.S. Pat. No. 4,628,893 to Robert B. Shaw, III discloses a bow hanger consisting of steel plate members and a hook that are attached on the upper bow limb. However, the Shaw '893 patent makes no provision for hanging the bow on a surface that will not accept a hook, and has the further drawbacks of adding weight to the upper limb of the bow which could potentially affect the balance of the bow.

U.S. Pat. No. 5,341,792 to Anthony D. Pucillo discloses an archery bow and appurtenance that inhibits vibration, twisting, and splitting of the outer section of the bow limb and provides a means for supporting the bow by suspension. However, the Pucillo '792 patent fails to address a suspension means for surfaces that do not readily accept a hook, and, additionally, adds weight to the outer bow limb that could potentially change the balance of the bow.

Similarly, U.S. Pat. No. 5,310,150 to Robert J. Fecko discloses a tree mounted archery bow holder that is useful in a hunting situation that involves a tree stand. However, the Fecko '150 patent does not address other times when an archer might want to hang his bow, such as at the archery range, in a hunting blind apart from a tree, and in his closet at home. Additionally, the Fecko '150 device must be manually mounted with screws at each location and does not provide the ease of hanging the bow over a limb, fence, cable, or similar surface with a hook device. Furthermore, the Fecko '150 device has the deficiency of not being a mobile device, making it necessary to uninstall and reinstall the device each time the archer changes location.

Likewise, U.S. Pat. No. 5,738,080 to Philip M. Brocco discloses a bow hanger for an archery bow that is made of a hook attached to a Velcro® fastener. While the Brocco '080 patent provides a means for hanging the bow on a surface that accepts a hook, it does not provide a means for attaching to a surface that does not readily accept a hook. Additionally, the Brocco '080 device relies on a hook and loop fastener to support the bow while hanging, and such fasteners tend to attract lint, dirt, and other debris resulting in a loss of gripping power. The weight of a bow in addition to the debris build up could lead to the fastener coming apart and the bow being damaged in a fall. At the very least, the Brocco '080 device would need to be replaced if the gripping ability of the hook and loop fastener were compromised by debris.

Lastly, U.S. Pat. No. 5,377,657 to Gary D. Foster and Curtis C. Foster discloses an archery bow holder that is attached to the floor of a tree stand to receive the bow. However, the Foster '657 patent does not provide for a means to support the bow for any other situation, such as on a tree limb, a fence, on the archery range, or in a closet. The Foster '657 device has the additional deficiency of not being a mobile device, making it necessary to uninstall and reinstall the device each time the archer changes location.

While the above-described devices fulfill their respective, particular objectives and requirements, the aforementioned patents do not describe an archery bow hanger that allows for the ease and mobility of hanging the bow on virtually any elevated horizontal or vertical surface. The Fecko '150 and Foster '657 patents make no provision for easily hanging a bow by a hook on any convenient horizontally elevated surface such as a fence, a tree limb, a cable, a closet pole, or the top of a wall. Additionally, the Fecko '150 and Foster '657 devices are more suitable for stationary positioning and must be uninstalled and reinstalled each time an archer changes location. While the Shaw '893, Pucillo '792, and Brocco '080 patents all provide a hook by which to hang a bow on a convenient surface, none of these devices makes provision for hanging the bow if a convenient horizontally elevated surface is not available, such as a tree with limbs that are too wide for the hook to fit over or are too high to reach. Furthermore, the Shaw '893 and Pucillo '792 devices are composed of metal pieces that are attached to the bow limbs, which could alter the balance of the bow. Finally, the Brocco '080 relies on a hook and loop fastener to hold the weight of the bow. Such fasteners typically collect any debris to which they are introduced which, in turn, decreases the integrity of the fastener, leading to potential damage to the bow in a fall.

Therefore, a need exists for a new and improved archery bow hanger that can be used for conveniently hanging a bow on a vertical or horizontal surface. In this regard, the present invention substantially fulfills this need. In this respect, the archery bow hanger according to the present invention substantially departs from the conventional concepts and designs of the prior art, and in doing so provides an apparatus primarily developed for the purpose of hanging an archery bow to provide free use of the hands for other activities.

SUMMARY OF THE INVENTION

In view of the foregoing disadvantages inherent in the known types of archery bow hangers now present in the prior art, the present invention provides an improved archery bow hanger, and overcomes the above-mentioned disadvantages and drawbacks of the prior art. As such, the general purpose of the present invention, which will be described subsequently in greater detail, is to provide a new and improved archery bow hanger which has all the advantages of the prior art mentioned heretofore and many novel features that result in an archery bow hanger which is not anticipated, rendered obvious, suggested, or even implied by the prior art, either alone or in any combination thereof.

To attain this, the present invention essentially comprises an archery bow hanger consisting of an L-shaped bracket which attaches to a bow at the quiver or sight mount, a hollow metal tube attached at one end to the bracket, and a hook attached to the opposite end of the tube. The hook is placed over any convenient surface, such as a tree limb, a fence, a cable, or a closet pole so that the bow is suspended.

A second embodiment of the present invention consists of the inclusion of a screw eye with the aforementioned archery bow hanger for the purpose of hanging the bow on a vertical surface which does not readily accept the hook, such as a tree with limbs that are out of reach or a wall where the top is too wide for the hook or out of the archer's reach.

There has thus been outlined, rather broadly, the more important features of the invention in order that the detailed description thereof that follows may be better understood and in order that the present contribution to the art may be better appreciated.

The invention may also include an angled portion of the L-shaped bracket which is adaptable for right-handed or left-handed archers, allowing the archer to notch arrows on the bow while it is suspended. There are, of course, additional features of the invention that will be described hereinafter and which will form the subject matter of the claims attached.

Numerous objects, features and advantages of the present invention will be readily apparent to those of ordinary skill in the art upon a reading of the following detailed description of presently preferred, but nonetheless illustrative, embodiments of the present invention when taken in conjunction with the accompanying drawings. In this respect, before explaining the current embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved archery bow hanger that has all of the advantages of the prior art archery bow hangers and none of the disadvantages.

It is another object of the present invention to provide a new and improved archery bow hanger that may be easily and efficiently manufactured and marketed.

An even further object of the present invention is to provide a new and improved archery bow hanger that has a low cost of manufacture with regard to both materials and labor, and which accordingly is then susceptible of low prices of sale to the consuming public, thereby making such an archery bow hanger economically available to the buying public.

Still another object of the present invention is to provide a new archery bow hanger that provides in the apparatuses and methods of the prior art some of the advantages thereof, while simultaneously overcoming some of the disadvantages normally associated therewith.

Even still another object of the present invention is to provide an archery bow hanger for use on both horizontally elevated surfaces and vertical surfaces. This allows the archer the freedom to use his hands for other activities, increasing the enjoyment of the sport of archery and hunting.

Yet another object of the present invention is to provide a mobile archery bow hanger for use by the archer. This allows increased speed and stealth for the hunter since the archery bow hanger presented can be used quickly and quietly.

Lastly, it is an object of the present invention to provide an adaptation for both right-handed and left-handed archers allowing arrows to be notched while the bow is suspended. This ensures that the archer will be ready to shoot almost instantaneously, even if he has been sitting for an extending amount of time.

These together with other objects of the invention, along with the various features of novelty that characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various figures.

DESCRIPTION OF THE PREFERRED EMBODIMENT

Figure 1:
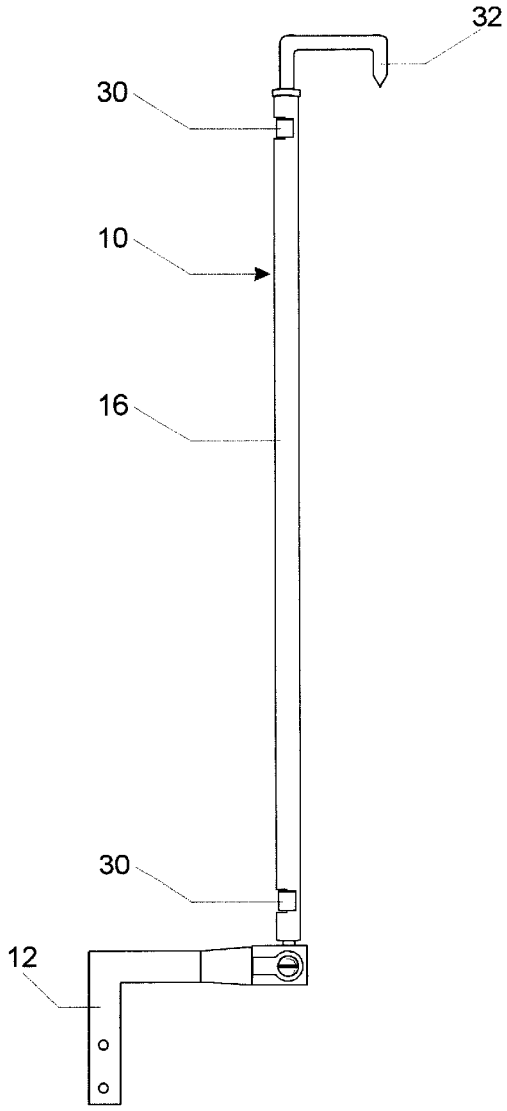
FIG. 1 is a right side view of the preferred embodiment of the archery bow hanger constructed in accordance with the principles of the present invention.

Referring now to the drawings, and particularly to FIGS. 1–4, a preferred embodiment of the archery bow hanger of the present invention is shown and generally designated by the reference numeral 10.

Figure 2:
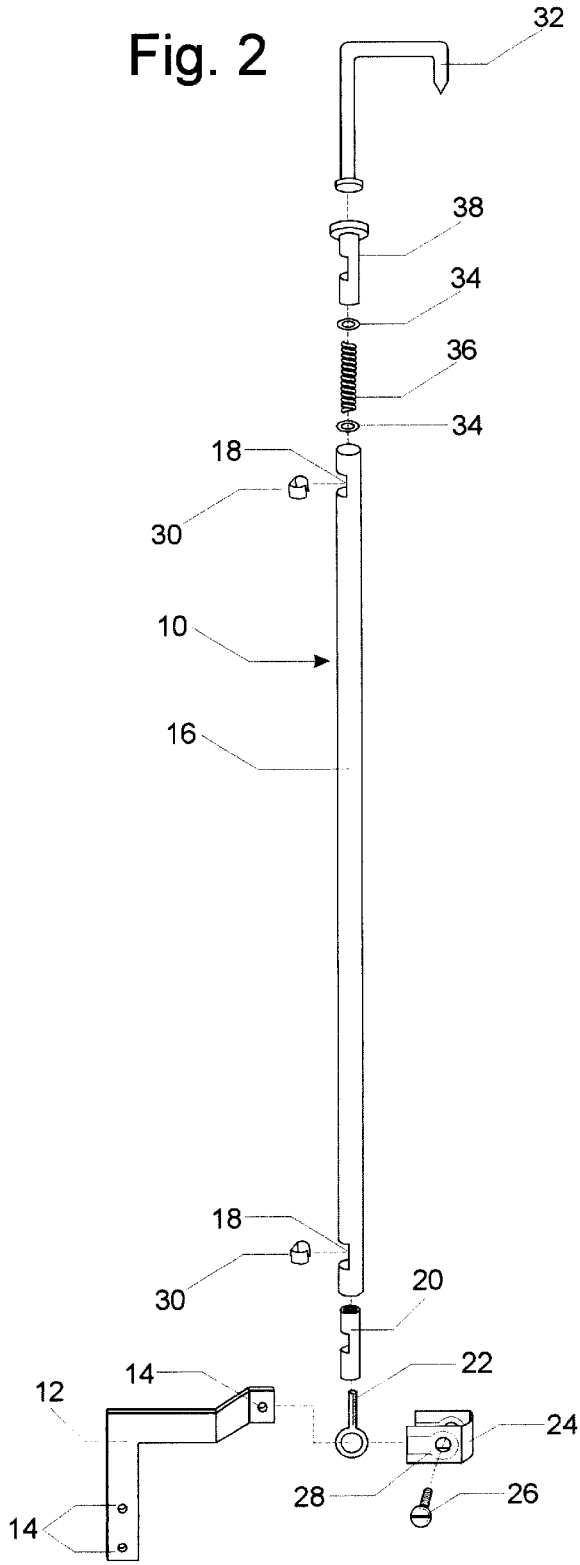
FIG. 2 is an expanded right side view of the archery bow hanger of the present invention.

In FIGS. 1 and 2, a new and improved archery bow hanger 10 of the present invention for hanging a bow is illustrated and will be described. FIG. 2 shows a more detailed depiction of the parts and connections required for the archery bow hanger 10. More particularly, the archery bow hanger 10 has an L-shaped metal bracket 12 with a pair of mounting holes 14 on one end and a single mounting hole 14 on the other end. The mounting holes 14 would be standard 10–24 mounting holes. A hollow metal tube 16 having a notch 18 near each end is attached on the end of the bracket 12 having the single mounting hole 14. The attachment is accomplished by sliding a hollow plastic end plug 20 into the bottom of the hollow metal tube 16, sliding an eye bolt 22 into the end plug 20, bracketing the eye bolt 22 with an adjustable screw clip 24, and inserting a screw 26 into the screw holes 28 of the screw clip 24. The attachment is secured by placing a metal end clip 30 over the notch 18 in the metal tube 16. A bent metal hook 32 is attached at the top of the metal tube 16. The attachment is accomplished by inserting a washer 34, a spring 36, a second washer 34, and a threaded plastic end plug 38 into the metal tube 16 and finally by screwing the bent metal hook 32 into the threaded plastic end plug 38. The attachment is secured by placing a metal end clip 30 over the notch 18 in the metal tube 16.

Figure 3:
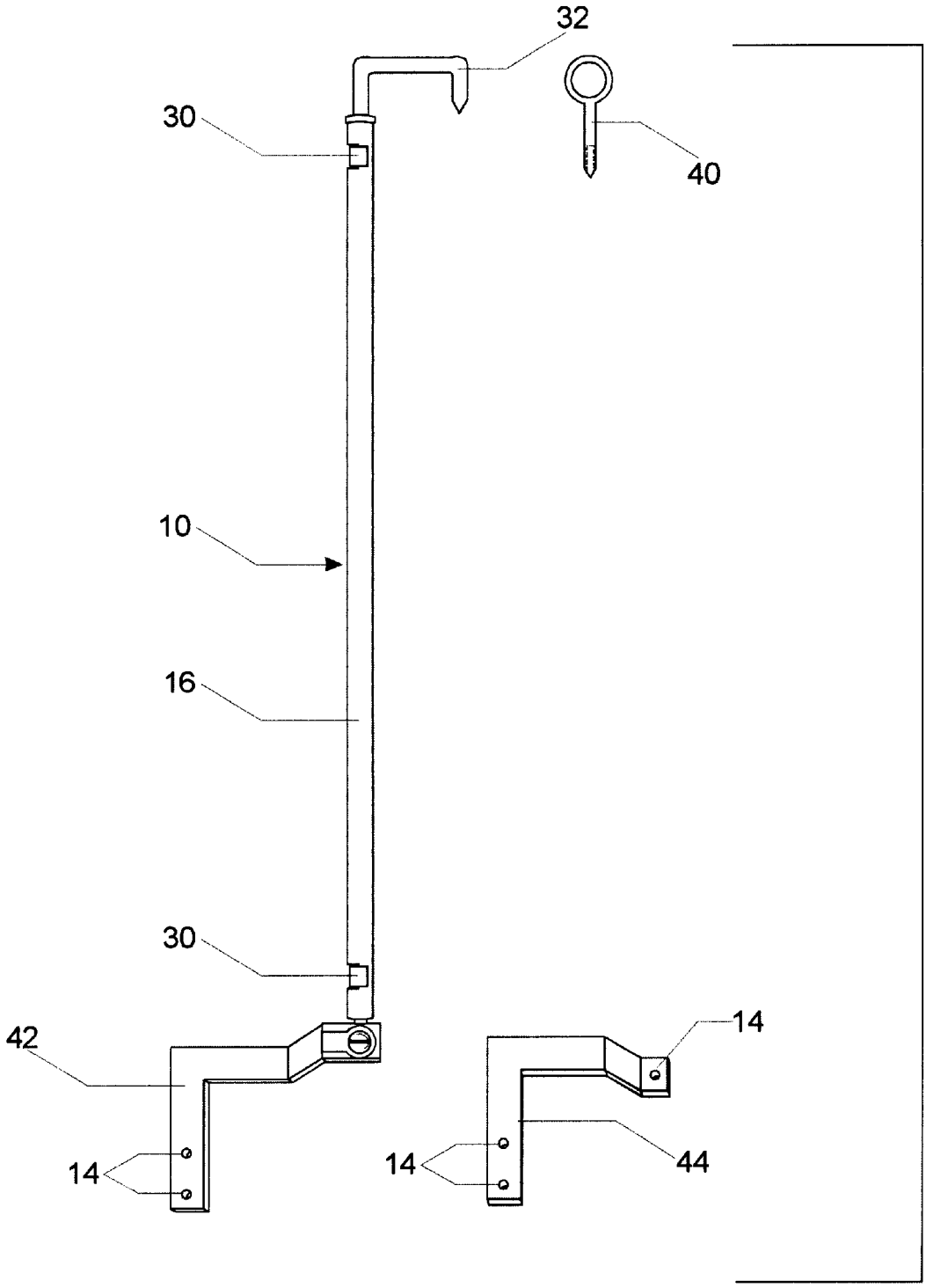
FIG. 3 is a right side view of a second embodiment of the present invention.
Figure 4:
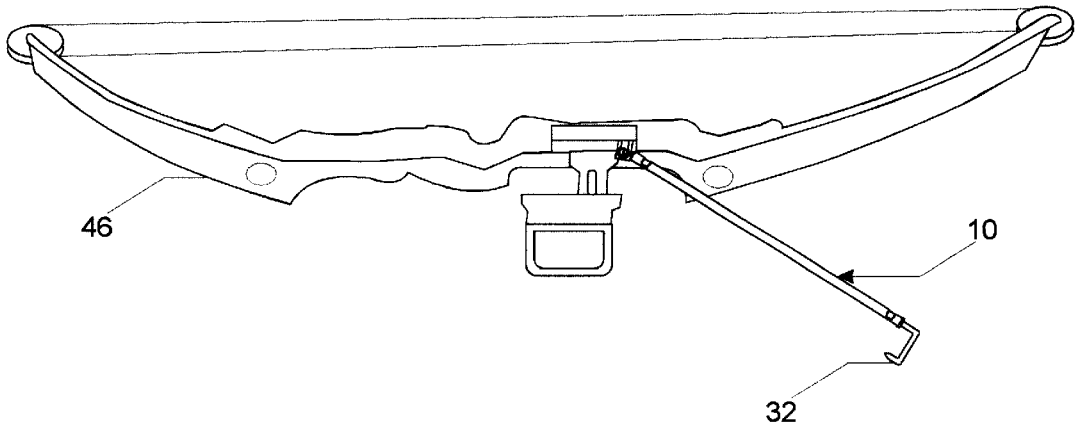
FIG. 4 is a top perspective view of the archery bow hanger of the present invention when it is attached to a compound bow.

FIG. 3 shows a right side view of a second embodiment of the present invention. The addition of a screw eye 40 to the archery bow hanger 10 allows for hanging the bow 46 of FIG. 4 even when tree limbs are not available. The user simply inserts the screw eye 40 into a suitable surface and inserts the hook 32 into the screw eye 40. FIG. 3 also shows the right-handed bracket 42 and the left-handed bracket 44. The use of the appropriate bracket 12 allows the user to notch arrows while the bow 46 is hanging. In this way, the archer is ready to shoot at all times, making the hunt more relaxing.

In use, it can now be understood that when an archer needs to hang his bow, he simply mounts the archery bow hanger 10 by inserting screws through the mounting holes 14 and into the standard 10–24 quiver or sight mount screw holes available on the bow 46. He then looks for either a tree limb or an appropriate surface on which to hang the bow 46. If a tree limb is available, the archer simply places the hook 32 over the limb. This allows the archer to have the bow within reach at all times, even while climbing a tree, since he can simply place the hook 32 over a higher limb as he climbs. If a limb is not available, the archer simply inserts the screw eye 40 into an appropriate surface and inserts the hook 32 into the screw eye 40. Either placement allows the archer the temporary use of his hands for other necessities.

While a preferred embodiment of the archery bow hanger has been described in detail, it should be apparent that modifications and variations thereto are possible, all of which fall within the true spirit and scope of the invention. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention. For example, any suitable sturdy material such as steel, aluminum, titanium, PVC, plastic, or a variety of wood may be used instead of the hollow metal tube described. Also, the metal hook may also be made of steel, aluminum, titanium, PVC, heavy-duty plastic, wood, or similar material. And although hanging an archery bow has been described as the main function, it should be appreciated that the archery bow hanger herein described is also suitable for hanging any other device which has the appropriate mounting screw holes available.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A bow hanger comprising:

a bracket having two ends and formed such that an aperture exists at one end and a plurality of apertures exist at an opposite end, wherein said bracket is formed such that it has a flat, L-shaped member and an angled member such that said angled member departs from the plane in which said L-shaped member exists;

a hollow tube having a top and a bottom and attached at said bottom to said one end of said bracket;

a hook having a top and a bottom and attached at said bottom to said top of said hollow tube.

2. The bow hanger of claim 1 wherein said angled member departs from said L-shaped member in a direction that benefits a right-handed archer.

3. The bow hanger of claim 1 wherein said angled member departs from said L-shaped member in a direction that benefits a left-handed archer.

4. A bow hanger comprising:

a bracket having two ends and formed such that an aperture exists at one end and a plurality of apertures exist at an opposite end, wherein said bracket is formed such that it has a flat, L-shaped member and an angled member such that said angled member departs from the plane in which said L-shaped member exists;

a hollow tube having a top and a bottom and attached at said one bottom to said one end of said bracket;

a hook having a top and a bottom and attached at said bottom to said top of said hollow tube;

a screw eye formed such that it has a circular opening for the purpose of attaching said screw eye to a vertical surface such that said hook may be placed in said circular opening for suspension of said bow hanger from said screw eye.

5. The bow hanger of claim 4 wherein said angled member departs from said L-shaped member in a direction that benefits a right-handed archer.

6. The bow hanger of claim 4 wherein said angled member departs from said L-shaped member in a direction that benefits a left-handed archer.

* * * * *